United States Patent [19]

Romerein et al.

[11] Patent Number: 4,990,109

[45] Date of Patent: Feb. 5, 1991

[54] COAXIAL CABLE TERMINAL

[75] Inventors: Robert L. Romerein; Mark C. Adamson; Zdenek J. Nepovim, all of Lindsay, Canada

[73] Assignee: J. E. Thomas Specialties Limited, Ontario, Canada

[21] Appl. No.: 553,561

[22] Filed: Jul. 18, 1990

[51] Int. Cl.[5] ..... H01R 4/42

[52] U.S. Cl. ..... 439/801; 439/63

[58] Field of Search ..... 439/801, 809, 63, 806

[56] References Cited

U.S. PATENT DOCUMENTS

| | | | |
|---|---|---|---|
| 1,760,035 | 5/1930 | Bedard | 439/801 |
| 4,138,179 | 2/1979 | Miller et al. | 439/63 |
| 4,428,632 | 1/1984 | Rich | 439/63 |

FOREIGN PATENT DOCUMENTS

| | | | |
|---|---|---|---|
| 1257922 | 1/1968 | Fed. Rep. of Germany | 439/809 |
| 1322932 | 2/1963 | France | 439/801 |
| 242312 | 7/1987 | German Democratic Rep. | 439/801 |

*Primary Examiner*—Gary F. Paumen

[57] ABSTRACT

A terminal for connecting the central pin of a coaxial cable has lower and upper clamping plates on a circuit board. The lower plate moves between extended position where it will clamp the connector and retracted position where the circuit board may be lifted away from the connector.

21 Claims, 3 Drawing Sheets

COAXIAL CABLE TERMINAL

BACKGROUND OF THE INVENTION

This invention relates to terminal means for electrically connecting the pin of the central conductor of a coaxial cable to electrical circuitry on an insulating circuit board.

The insulating circuit board will usually be a printed circuit board.

The invention will have principal application in cable television (CATV) circuitry but is by no means limited thereto.

In CATV and similar applications, components such as directional couplers, line splitters, power inserters, amplifiers, taps, etc, have their circuits on a printed circuit board of insulating material contained in a metal housing with lid. With one or more coaxial cables mechanically attached to the housing and the central conductors thereof projecting through a side wall thereof; the central coaxial conductor is connected to the circuitry on the circuit board while the outer conductor is connected to the metal housing. In case of malfunction, it is desireable that a serviceman be able to easily remove the cover and then the circuit board and replace it with a new circuit board. When the upper limit of the bandwidth was 700 Megahertz (MHz) or lower, the circuit board could be made considerably smaller than the inner dimensions of the metal housing and disconnecting and connecting the central coaxial conductor from the circuit board could be performed relatively easily by a variety of means because of the relatively large clearance between the board and the inner dimensions of the housing. However with bandwidths above 700 MHz and, in some cases, up to 1000 MHz (1 Gigahertz (GHz)) or higher, the effect of the ambient physical components on the circuit parameters has rendered it desireable that the dimensions of the circuit parameters has rendered it desireable that the dimensions of the circuit board approach as closely as reasonably possible to inner housing dimensions. It is therefore desireable that, to replace a malfunctioning circuit board, the board be electrically disconnectable and removable directly upwardly out of the casing (and perpendicularly to the plane of the board and the pins of the central conductor which extend inwardly through the housing side walls). The replacement board equally should be designed to be moved downwardly perpendicular to the plane of the board and the pin axis; and, in situ, easily connected to the pin.

The terms 'top' and 'bottom' and 'upward' and 'downward' relate to the convention used herein that the lid is on the top or upper side of the casing and this convention is adhered to herein even though in some applications the lid may be horizontally, downwardly or otherwise disposed relative to the housing.

By 'pin' herein I mean the stub end of a central coaxial conductor, projecting beyond the remainder of the conductor usually used for connecting the central conductor to a circuit component.

SUMMARY OF THE INVENTION

It is an object of the inventions to provide a terminal for connecting the central pin of a coaxial conductor to the circuit on a circuit board which will allow disconnection of a circuit board from and connection of a circuit board to the central conductor without movement of the circuit board in a direction other than perpendicular to the plane of the circuit board, that is only upwardly and downwardly where the circuit board is mounted in a housing.

It is an object of the invention to provide a terminal for connecting the central pin of a coaxial conductor where the terminal comprises an upper plate and a lower plate mounted on the circuit board and adapted to clamp the central pin between them for connection to a circuit on the circuit board; where the lower plate may be moved between clamped and unclamped position. In clamped position the lower plate is below the central pin and in unclamped position the lower plate may be moved parallel to the plane of the circuit board between an extended position where such clamping may take place and a retracted position where the lower plate is no longer below the central pin and hence the malfunctioning circuit board with the lower plate retracted, with mechanical disconnection from the housing if necessary, may be moved upwardly away from the central pin in a direction perpendicular to the circuit board (i.e. if there is a housing, upwardly out of the housing) and a replacement circuit board with the lower plate retracted may be moved into position perpendicular to the plane of the circuit board (and downwardly if there is a housing) for movement of the lower plate into extended clamping position below the pin followed by convenient clamping of the pin between upper and lower plates.

It is an obJect of a preferred aspect of the invention to provide a terminal where the upper plate is fixed to the circuit board and the lower plate is connected to a shank riding in a slot defined in at least one of the upper plate or the circuit board and movable in the slot with the lower plate between extended and retracted position The lower plate and shank are adapted in cooperation with at least one of the upper plate and mounting board to clamp and unclamp the central pin to the upper plate with the lower plate in extended position.

It is an object of a preferred aspect of the invention where the shank of the previous paragraph is a bolt threaded into the lower plate and rotatable relative to the upper plate while shaped to prevent downward movement relative to the latter. Accordingly rotation of the bolt in one direction or the other relative moves the lower plate into and out of position clamping the pin between lower and upper plates, while in unclamped position the lower plate may be moved between retracted and extended position along the slot.

An obJect of a preferred aspect of the invention described in the previous paragraph is to provide an extension of the lower plate which rides in a slot extent to maintain the orientation of the lower plate relative to the board.

BRIEF DESCRIPTION OF THE DRAWINGS

In drawings which illustrate a preferred embodiment of the invention.

BRIEF DESCRIPTION OF THE INVENTION

Figure 1:
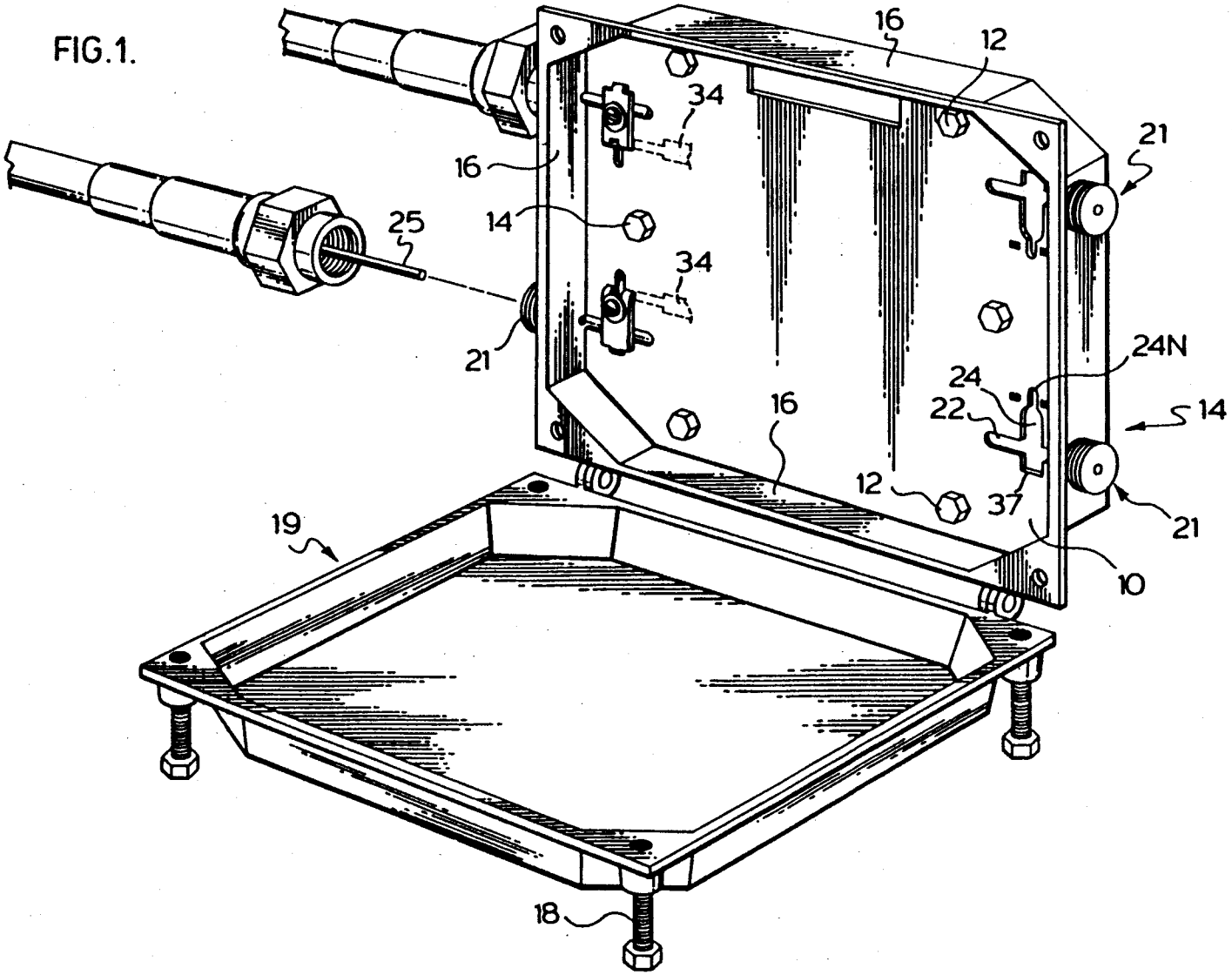
FIG. 1 is a perspective view of a housing, with terminals in accord with the invention.
Figure 2:
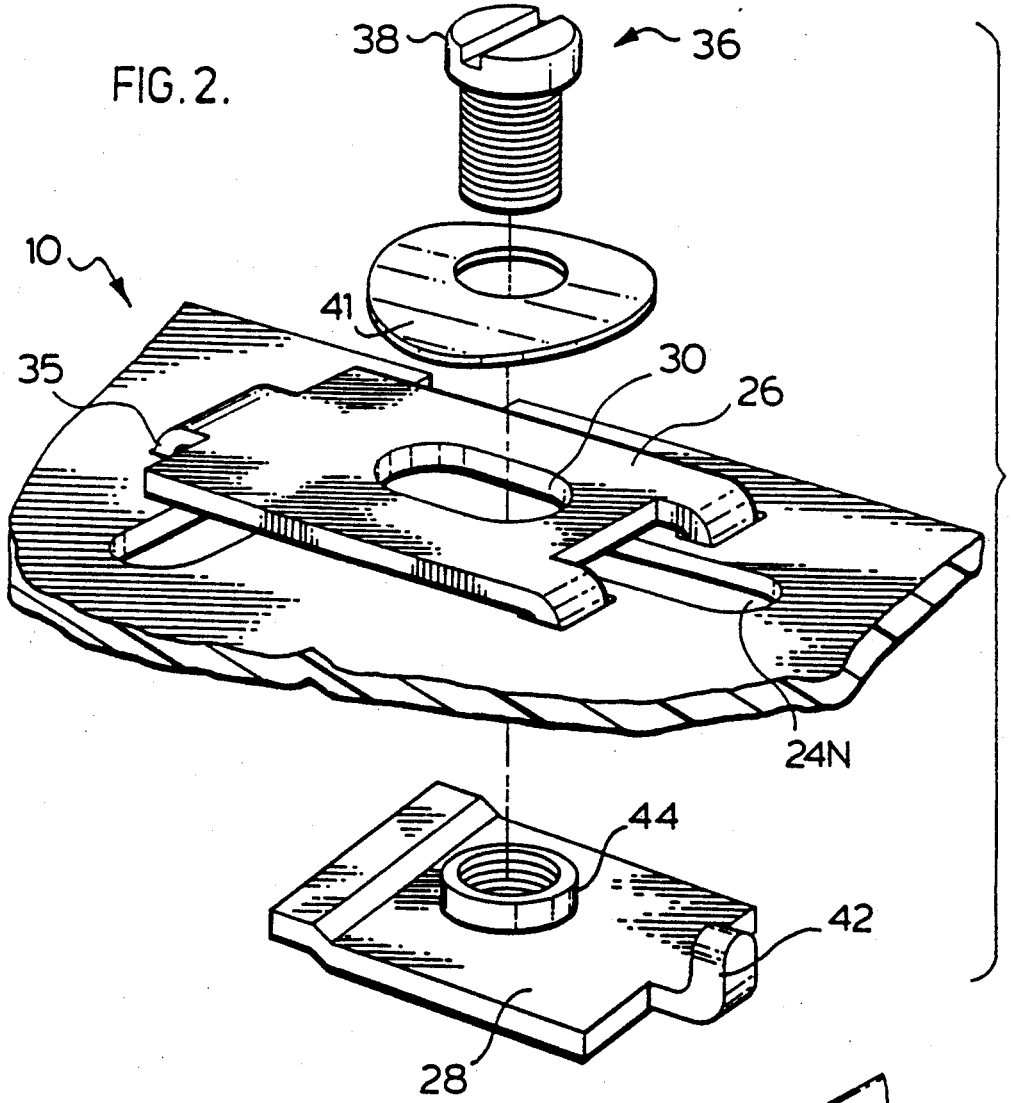
FIG. 2 is an exploded view of a terminal and circuit board.
Figure 3:
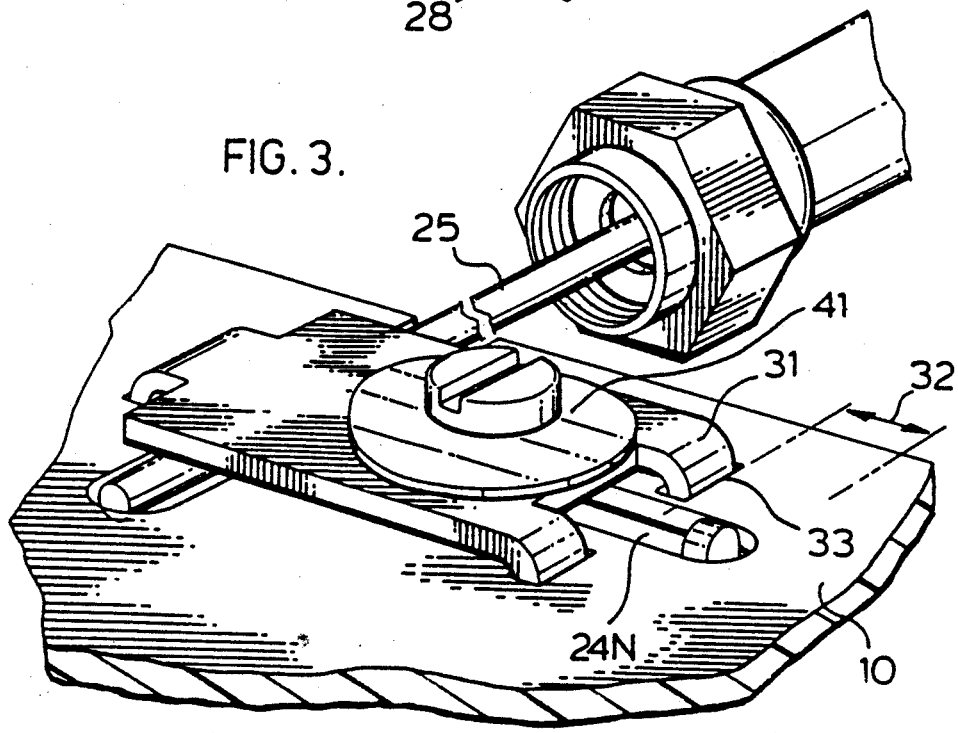
FIG. 3 shows a circuit board, with a pin in place and the connector in phantom.

In the drawings is shown a printed circuit board 10 mounted by mounting screws 12 in a metal housing 14. The housing has side walls 16 perpendicular to the plane of the printed circuit board and a bottom wall (not shown) therebelow. A lid, 19 is hinged to the side walls of the housing to close it about the printed circuit board and it may be bolted closed by bolts 18.

The housing side walls 16 customarily contain entrance ports for a plurality (here four of which three are in use) of coaxial cable ports 21 for the mounting of coaxial cable ends. At each port, the cable end mounted by one of a number of conventional techniques is attached with the outer coaxial conductor electrically connected to the metal housing by well known means while the inwardly proJecting stub or pin 25 of the central conductor proJects into the interior of the housing as shown.

Mounted inside the housing is the circuit board 10, of insulator material and because the frequencies carried by the system may reach as high as 750 MHz or 1 GHz or higher the board is designed to approach as closely as possible within reasonable tolerances to the side walls 16 of the housing. The circuit board is mounted on the housing by a plurality of mounting screws 12.

The circuitry of the board is not shown here in detail as it may embody any number of circuits conventional in the CATV or analogous fields. For example in the CATV field the circuitry may be 'passive', that is, may be such circuits as a splitter, coupler, power inserter, tap or may be an 'active circuit' such as an amplifier of one of various types or may be any other circuit carried on a circuit board for connection to a coaxial cable. The terminal described herein may be used to attach a circuit board to a coaxial cable without the presence of a metal housing but most applications now conceived contemplate the circuit board mounted in a metal housing.

On the circuit board used with the invention is a slot 22 extending inwardly from the edge of board 10 with each slot located and oriented to receive the pin of a coaxial cable projecting inwardly from a port 21. (It is convenient but not essential to the invention that the diameter of the pin 25 is approximately equal to the thickness of the printed circuit boards 20.) At one side of each slot 22, and intermediate its length, is a side slot 24 for a purpose to be hereafter described. The location of slot 24 along slot 22 is determined by the position at which it is desired to make the electrical connection to the pin. Slot 24 is narrowed toward its closed end 24N.

A top plate 26 is located on the upper surface of the circuit board and attached to the board in any suitable manner and is designed to extend over slot 22 and to provide the short slot 30 aligned with circuit board slot 24 over a small extent of its length from its meeting with slot 22. As shown the top plate 26 is preferably attached to the circuit board with tabs 31 extending through slots 33 and tab 35 extending through a rectilinear slot 37 extending from slot 22 in a direction opposed to slot 24. The tabs are soldered to the lower side of board 10 for retention. It will be noted that the narrow end 24N of slot 24 is exposed for a predetermined slot extent 32 of approximately the length of slot 30. Each top plate 26 is soldered preferably at one of tabs 31 to a printed circuit conductor shown partially at 34 for electrical connection thereto. Whatever electrical circuit (not shown) is embodied on the printed circuit board will be appropriately connected to the proper ones of conductors 34.

It will be noted that bottom plate 28 is preferably formed to have a raised portion at 27 to fill a small lower level of slot 22 in the clamped position.

Figure 4:
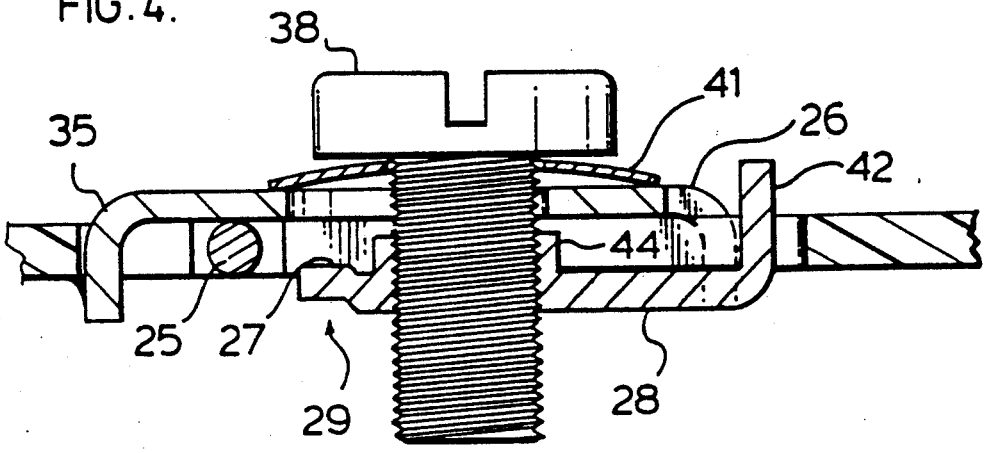
FIG. 4 shows a section along the line 4—4 of FIG. 1 showing a lower plate in retracted position.
Figure 5:
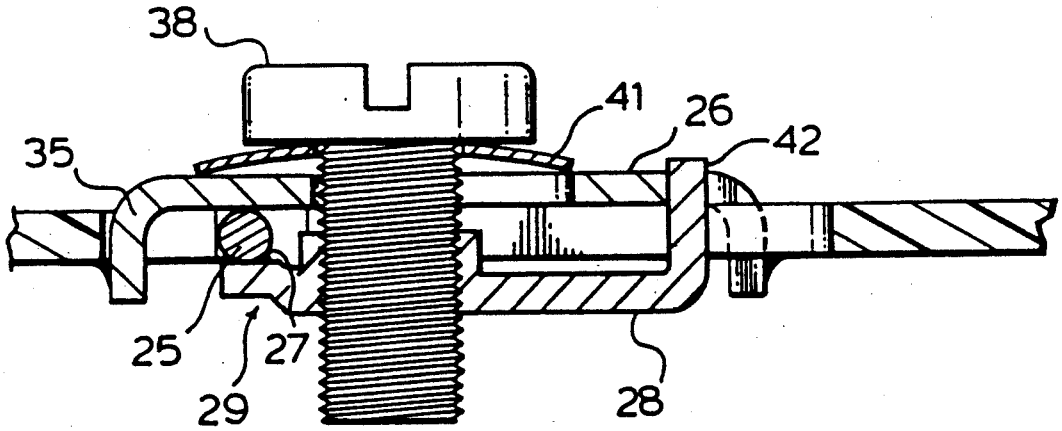
FIG. 5 shows a view similar to FIG. 4 with the lower plate in extended position.

A shank, here embodied by a bolt 36, is designed to extend through and ride in the passageway formed by the registering portion of slots 24 and 30. The bolt 36 is provided with a head 38 designed to slide above the upper surface of top plate 26 and a slot for rotation by a screw driver. The bolt is threaded into lower plate 28 which extends generally along and below slot 24 and is wider than slot 24. The lower plate contains a portion being a raised portion 27 designed to underlie or be adjacent to slot 22 and at its other end an upwardly bent extension 42 designed to ride in the exposed extent 32 of slot 24N. It is noted that lower plate preferably includes a boss 44 extending into slot 24 and including the threaded mounting for bolt 36. The lower plate 28 with its attached bolt is dimensioned relative to slots 22, 24, 30 and extent 32 to move between an extended and a retracted position. In extended position (FIG. 5) the portion 27 underlies slot 22 and any pin therein. In extended position the lower plate 28 may be moved between clamped position and unclamped position by rotation in one direction or the other respectively of bolt 36. In clamped position the lower plate is raised to clamp the pin between upper plate 26 and the portion 27 of lower plate 28. If desired raised portion 27 could have been replaced by a lower convexity of upper pate 26 or if the diameter of pin 25 is greater than the thickness of the circuit board, clamping could be achieved with flat upper and lower plates. With the lower plate in unclamped position, the lower plate may be moved by bolt head 38 or extension 42 between extended and retracted position. In such movement extension 42 rides in slot extent 32 to maintain the orientation of the lower plate relative to the circuit board and upper plate. In retracted position (FIG. 4) the projection 28 is clear of slot 22 so that, if its mounting screws 12 are unscrewed from the housing the board may be lifted away from the pins and the housing, in an upward direction perpendicular to the plane of the board.

Preferably the bolt 36 is provided with saddle shaped washer 41 arranged to ride between bolt head 38 and plate 36 to bias the bolt and connected lower plate 28 upwardly. Thus in the retracted position of lower plate 28 with bolt 36 loosened from clamping, the washer 41 biases bolt and plate 28 upwardly so that the plate 28 contacts the lower surface of board 10 (FIG. 4) and inhibits loose movement of the lower plate 28 when bolt 36 is loosened. In extended position bolt 36 draws plate 28 into clamping position against the biasing pressure of washer 41. Other means for biasing the plate 28 upwardly in retracted position may be used.

In operation, for use, the board is mounted on the housing, each pin resting in a slot 22 and clamped between a lower plate and the upper. The housing lid is in place.

To replace a malfunctioning circuit board the cover of the housing is opened and the mounting screws 12 removed from the housing. At each pin the bolt 36 is operated to move the lower plate 28 to unclamped position and the lower plate is then moved to retracted position. The circuit board may then be lifted out of the housing without stress on the pins 25. The new circuit board with the lower plates in retracted position is then lowered into place with its lower plate retracted and the pins rest in the slots 22 of the new board. The lower plates 28 are then moved to extended position under the pins 42 and clamped by operation of bolts 36. The new board is then fastened to the housing by mounting screws 50.

It is within the scope of the invention to use means other than a threaded bolt to move upper and lower plates between clamped and unclamped position and other means than those shown to move the lower plate between extended and retracted position It should also be noted that the movement between extended and retracted position may be such that the retracted position of the lower plate may be inward rather than laterally from the extended position.

I claim:

1. Terminal for connecting a central pin of a coaxial cable to electrical circuitry on a circuit board of insulating material, comprising:

an upper plate attached to said circuit board and arranged to contact the upper surface of said coaxial cable pin which pin extends inwardly beyond an edge of said printed circuit board, a lower plate securable to one of said upper plate or said circuit board and slidable between extended and retracted positions, transverse to the longitudinal axis of said coaxial cable pin, wherein in the extended position the lower plate may contact the lower surface of said coaxial cable pin, said board and upper plate being adapted, with said lower plate in the retracted position, to move upwardly away from said pin, said upper and lower plate being adapted, with said lower plate in the extended position, to assume a clamped or unclamped position relative to said cable pin, means in the extended position of said lower plate for moving said upper and lower plate between the clamped and unclamped positions.

2. Terminal as claimed in claim 1 wherein said circuit board is provided with a slot designed to receive said pin when said pin is extending inwardly beyond said edge.

3. Terminal as claimed in claim 1 wherein a shank is attached to said lower plate and extends upwardly through a passageway defined by a slot in at least one of said upper plate and said circuit board, said passageway allowing movement of said lower plate and said shank between the extended and retracted positions.

4. Terminal as claimed in claim 2 wherein a shank is attached to said lower plate and extends upwardly through a passageway defined by a slot in at least one of said upper plate and said circuit board, said passageway allowing movement of said lower plate and said shank between the extended and retracted positions.

5. Terminal as claimed in claim 3 wherein an extension from said lower plate extends upwardly to slide in a circuit board slot in movement of said lower plate between the extended and retracted positions said pro-Jection and said circuit board slot acting to maintain the orientation of said lower plate.

6. Terminal as claimed in claim 4 wherein an extension from said lower plate extends upwardly to slide in a circuit board slot in movement of said lower plate between the extended and retracted positions, said projection and said circuit board slot acting to maintain the orientation of said lower plate.

7. Terminal as claimed in claim 1 wherein a bolt is threaded to said lower plate to extend upwardly therefrom through a passageway defined by a slot in at least one of said upper plate and said circuit board, said passageway allowing movement of said shank between the extended and retracted positions, a head on said bolt shaped to bear downwardly on said upper plate, whereby with said bolt loosened a portion of said lower plate may be moved into the extended position under a pin located just below said upper plate and with said lower plate so located in the extended position said bolt may be tightened to raise said lower plate into clamping relationship with said pin and said upper plate.

8. Terminal as claimed in claim 7 wherein an extension from said lower plate extends upwardly to slide in a circuit board slot in movement of said lower plate between the extended and retracted positions, said extension and said circuit board slot acting to maintain the orientation of said lower plate.

9. Terminal as claimed in claim 1 including means for biasing said lower plate against said board when said lower plate is in the retracted position.

10. Terminal as claimed in claim 7 including means for biasing said lower plate against said board when said lower plate is in the retracted position.

11. Terminal for connecting a central pin of a coaxial cable on a circuit board of insulating material, comprising:

an upper plate attached to said circuit board and arranged to contact the upper surface of the coaxial cable pin extending inwardly beyond an edge of said printed circuit board, a lower plate securable to one of said upper plate or said circuit board and slidable between extended and retracted positions, wherein in the extended position the lower plate may contact the lower surface of the coaxial cable pin, said board and upper plate being adapted with said lower plate in the retracted position to move upwardly away from said pin, said upper and lower plate being adapted, with said lower plate in the extended position, to assume a clamped or unclamped position relative to said cable pin, means when said lower plate is in the extended position for moving said upper and lower plate between clamped and unclamped position.

12. Terminal as claimed in claim 11 wherein said circuit board is provided with a slot designed to receive said pin when said pin is extending inwardly beyond said edge.

13. Terminal as claimed in claim 11 wherein a shank is attached to said lower plate and extends upwardly through a passageway defined by a slot in at least one of said upper plate and said circuit board, said passageway allowing movement of said lower plate and said shank between the extended and retracted positions.

14. Terminal as claimed in claim 12 wherein a shank is attached to said lower plate and extends upwardly through a passageway defined by a slot in at least one of said upper plate and said circuit board, said passageway allowing movement of said lower plate and said shank between the extended and retracted positions.

15. Terminal as claimed in claim 13 wherein an extension on said lower plate extends upwardly to slide in a circuit board slot in movement of said lower plate between extended and retracted positions to maintain the orientation of said lower plate.

16. Terminal as claimed in claim 14 wherein an extension on said lower plate extends upwardly to slide in a circuit board slot in movement of said lower plate between the extended and retracted positions to maintain the orientation of said lower plate.

17. Terminal as claimed in claim 11 wherein a bolt is threaded to said lower plate to extend upwardly therefrom to extend through a passageway defined by a slot in at least one of said upper plate and said circuit board, said passageway allowing movement of said shank between the extended and retracted positions, a head on said bolt shaped to bear downwardly on said upper plate, whereby with said bolt loosened a portion of said lower plate may be moved into the extended position under a pin located just below said upper plate and with said lower plate so located in the extended position said bolt may be tightened to raise said lower plate into clamping relationship with said pin and said upper plate.

18. Terminal as claimed in claim 12 wherein a bolt is threaded to said lower plate to extend upwardly therefrom to extend through a passageway defined by a slot in at least one of said upper plate and said circuit board, said passageway allowing movement of said shank between extended and retracted positions, a head on said bolt shaped to bear downwardly on said upper plate, whereby with said bolt loosened a portion of said lower plate may be moved into extended position under a pin located Just below said upper plate and with said lower plate so located in extended position said bolt may be tightened to raise said lower plate into clamping relationship with said pin and said upper plate.

19. Terminal as claimed in claim 17 wherein an extension in said lower plate extends upwardly to slide in a circuit board slot in movement of said lower plate between the extended and retracted positions, said extension and said circuit board slot act to maintain the orientation of said lower plate.

20. Terminal as claimed in claim 18 wherein an extension in said lower plate extends upwardly to slide in a circuit board slot in movement of said lower plate between extended and retracted positions, said extension and said circuit board slot act to maintain the orientation of said lower plate.

21. Terminal as claimed in claim 11 including means for biasing said lower plate against said board when said lower plate is in the retracted position.

* * * * *